US005376772A

United States Patent [19]

Nakagawa et al.

[11] Patent Number: 5,376,772

[45] Date of Patent: Dec. 27, 1994

[54] ELECTROTHERMAL INSTRUMENT WITH HEAT GENERATING ELEMENT OF SINTERED BATIO$_3$ IN CONTACT WITH HEAT TRANSMITTING MEMBER

[75] Inventors: Tanehiro Nakagawa, Nagoya; Yoshiaki Ono, Gifu; Tsutomu Tomatsu; Takeo Yamaguchi, both of Nagoya, all of

[73] Assignee: The Pilot Ink Co., Ltd., Nagoya, Japan

[21] Appl. No.: 750,245

[22] Filed: Aug. 27, 1991

[30] Foreign Application Priority Data

Aug. 31, 1990 [JP] Japan ..... 2-91676[U]
Sep. 13, 1990 [JP] Japan ..... 2-97109[U]
Nov. 18, 1990 [JP] Japan ..... 2-120363[U]

[51] Int. Cl.$^5$ ..... A63H 33/22; H05B 1/02; H05B 3/00; H01C 7/02

[52] U.S. Cl. ..... 219/227; 219/221; 219/291; 219/253; 219/521; 392/379; 392/385; 392/485; 446/14; 401/1

[58] Field of Search ..... 219/221, 227–241, 219/242, 521, 385, 253, 254; 446/14; 401/1, 2; 392/379, 383–385, 485; 40/450; 359/288

[56] References Cited

U.S. PATENT DOCUMENTS

| | | | |
|---|---|---|---|
| 1,592,148 | 7/1926 | Munn . | |
| 3,354,564 | 11/1967 | Emmons et al. | 40/450 |
| 3,518,407 | 6/1970 | Andrich | 219/241 X |
| 3,584,190 | 6/1971 | Marcoux | 219/233 |
| 4,028,118 | 6/1977 | Nakasuji et al. | 106/21 |
| 4,176,273 | 11/1979 | Fujie et al. | 219/240 X |
| 4,238,665 | 12/1980 | Tremarco | 219/240 X |
| 4,305,223 | 12/1981 | Ho | 446/484 |
| 4,384,989 | 5/1983 | Kamgaito et al. | 252/62.3 |
| 4,421,560 | 12/1983 | Kito et al. | 106/21 |
| 4,468,555 | 8/1984 | Adachi et al. | 219/241 X |
| 4,720,301 | 1/1988 | Kito et al. | 106/21 |
| 4,725,462 | 2/1988 | Kimura | 446/14 |
| 4,816,648 | 3/1989 | Dusabek | 219/521 |
| 4,818,215 | 4/1989 | Taga | 431/126 |
| 4,917,643 | 4/1990 | Hippely | 446/14 |
| 4,920,991 | 5/1990 | Shibahashi et al. | 132/73 |
| 4,922,242 | 5/1990 | Parker | 359/288 |
| 5,011,445 | 4/1991 | Nakasuji et al. | 446/14 |
| 5,079,049 | 1/1992 | Kito et al. | 428/24 |
| 5,085,607 | 2/1992 | Shibahashi et al. | 446/14 |

FOREIGN PATENT DOCUMENTS

| | | | |
|---|---|---|---|
| 0100715 | 2/1984 | European Pat. Off. . | |
| 0382241 | 8/1990 | European Pat. Off. . | |
| 214638 | 10/1984 | German Dem. Rep. | 219/254 |
| 47-25955 | 7/1972 | Japan . | |
| 54-2524 | 1/1979 | Japan | 392/384 |
| 57-175074 | 10/1982 | Japan | 219/236 |
| 2066089 | 7/1981 | United Kingdom . | |
| 2124552 | 2/1984 | United Kingdom | 219/227 |
| 2205255 | 12/1988 | United Kingdom | 219/227 |
| 1389801 | 4/1988 | U.S.S.R. . | |
| 8810139 | 12/1988 | WIPO . | |

OTHER PUBLICATIONS

Patent Abstracts of Japan, vol. 12, No. 79 (P-676) Mar. 12, 1988.

*Primary Examiner*—Anthony Bartis
*Attorney, Agent, or Firm*—Fitzpatrick, Cella, Harper & Scinto

[57] ABSTRACT

An electrothermal color-varying instrument for inducing color change in a color-varying layer includes a heat generating element composed of a sintered barium titanate thermistor in face-to face contact with a heat transmitting member having a heating end portion for transmitting heat to the thermal color-varying layer. The thermistor has:

(i) a positive temperature coefficient on the electrical resistance within a temperature range from 25° C. to 70° C.;

(ii) a volume resistivity at 25° C. ($\rho_{25}$) within a range of $9.8\times10^{-3}$ to $2.97\times10^{5}$ Ω·cm; and (iii) a ratio ($\rho_{70}/\rho_{25}$) of the volume resistivity at 70° C. to that at 25° C. within a range of $5\leqq(\rho_{70}/\rho_{25})\leqq400$.

The electrothermal heat generating element generates heat under the application of a voltage in the range of 0.8 to 40 volts and maintains a saturated heating temperature within a range of 30 to 100 degrees C.

4 Claims, 7 Drawing Sheets

ELECTROTHERMAL INSTRUMENT WITH HEAT GENERATING ELEMENT OF SINTERED $BATIO_3$ IN CONTACT WITH HEAT TRANSMITTING MEMBER

BACKGROUND OF THE INVENTION

1. Field of the Invention

The present invention relates to an electrothermal color-varying instrument, and more particularly such instrument for inducing color change in a thermal color-varying layer provided in a toy, a picture book, a teaching aid, a writing board or the like.

2. Related Background Art

There is already proposed, for example in Japanese Laid-open Utility Model No. 62-139573 and Japanese Laid-open Patent No. 62-201128, an electrothermal heating instrument to be contacted with a thermal color-varying material provided on the surface of an animal toy or the like for varying the color of the contacted position.

Such conventional electrothermal heating instrument lacks, in the heat-generating element itself, the temperature self-controlling ability effective in a relatively low temperature range (about 70° C. or lower), thereby involving danger of overheating and requiring therefore a temperature control switch or the like, and also necessitates insulation, for example with a ceramic material, for the heat-generating part in order to prevent the danger of current leakage.

SUMMARY OF THE INVENTION

The object of the present invention is to provide an electrothermal color-varying instrument, capable of resolving the danger of overheating or current leakage in the prior art, rapidly heating the heat-generating element to a predetermined temperature by the application of a low voltage, and being less influenced in the heating temperature by the fluctuation in the ambient temperature, thereby handily inducing color change in the thermal color-varying layer of an object article.

BRIEF DESCRIPTION OF THE DRAWINGS

FIG. 21 is a chart showing tolerance of volume resistivity as a function of temperature;

FIG. 22 is a chart showing stable temperature of the heat-generating element at different ambient temperature;

FIG. 23 is a chart showing temperature of heat-generating element as a function of energizing time; and FIG. 24 is a chart showing hysteresis in color change.

DESCRIPTION OF THE PREFERRED EMBODIMENTS

Figure 1:
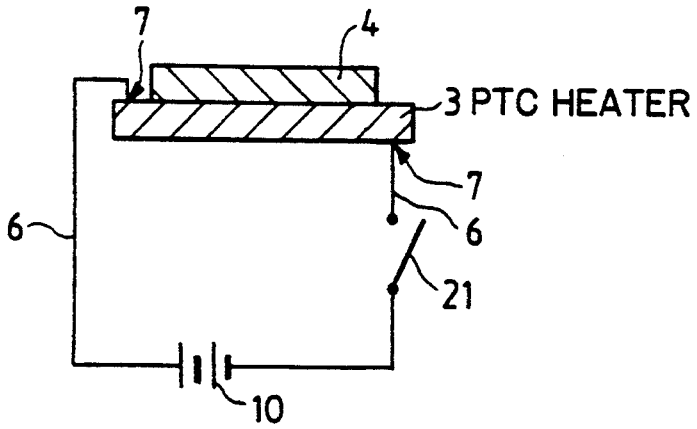
FIGS. 1 to 3 are schematic cross-sectional views showing the mode of mounting of an electrothermal heat-generating element.

Now the present invention will be clarified in detail by embodiments thereof shown in the attached drawings.

The electrothermal color-varying instrument of the present invention, to be brought into contact with or in proximity to a thermal color-varying layer 8 provided at least in a part of the surface of a toy, a picture book, a teaching aid, a writing board or the like for including color change in said thermal color-varying layer, is featured by a fact that an electrothermal heat-generating element functioning as a heat source is composed of a thermistor which has (i) a positive temperature coefficient on the electrical resistance at least in a temperature range from 25° to 70° C.;

(ii) a volume resistivity at 25° C. ($\rho_{25}$) within a range from $9.8\times10^{-3}$ to $2.97\times10^{5}$ Ω·cm; and (iii) a ratio ($\rho_{70}/\rho_{25}$) of the volume resistivity at 70° C. to that at 25° C. within a range of $5\leqq(\rho_{70}/\rho_{25})\leqq400$, is adapted to generate heat by the application of a voltage of 0.8 to 40 V, and is capable of temperature self-control at an arbitrary saturation temperature within a range from 30° C. to 100° C..

Under such conditions, the electrothermal heat-generating element has a size of 0.05–30 $cm^2$ (area of one side) and a thickness of 0.05–1.0 cm for practical use in the present invention, and the heat-generating elements within the above-mentioned range may also be employed in suitable combinations.

An element of a smaller area than the above-mentioned range is associated with insufficient safety, because heating to a desired temperature cannot be attained unless the element is elevated to a very high temperature, while an element of a larger area cannot achieve temperature elevation within a short time by the application of a low voltage.

The electrothermal heat-generating element can be composed, for example, of a sintered material based on $BaTiO_3$ (rendered semi-conductive by doping with a rare earth element, followed eventually by substitution with another element such as Sr), a monocrystalline material based on Si, or an organic plastic material (conductive fine powder such as graphic blended in crystalline low-melting plastic), among which the sintered material based on $BaTiO_3$ is preferred in consideration of adjustability of saturation heating temperature in the low temperature range (30° to 100° C.) and temperature elevation characteristics. The heat-generating element may be shaped as a disk, a belt, a honeycomb-form or other suitable forms according to the purpose.

In the following there will be explained the characteristics of the electrothermal heat-generating element adapted for use in the present invention, with reference to charts shown in FIGS. 20–23.

The heat-generating element is required to have a positive temperature coefficient on the electrical resistance at least in a range of 25° to 70° C., and to have a steep increase of resistance with increase in temperature (FIG. 20), whereby the amount of generated heat rapidly decreases with the increase in resistance to enable self-control of temperature.

Furthermore, the heat-generating element is required to have a volume resistivity at 25° C. ($\rho 25$) within a range of $9.8\times10^{-3}$ to $2.97\times10^{5}$ Ω·cm, or, more specifically, a volume resistivity ($\rho$) at different temperatures within upper and lower limits shown in FIG. 21, and a ratio $\rho_{70}/\rho_{25}$ of the volume resistivity at 70° C. to that at 25° C. within a range $5\leqq\rho_{70}/\rho_{25}\leqq400$.

These conditions allow to provide a heat-generating element having heat generating characteristics and temperature self-controlling ability in the low temperature range (not exceeding 100° C., preferably not exceeding 70° C.). If the volume resistivity of the heat generating element is above the upper limit, the temperature cannot be elevated to a desired value within a short time unless the voltage is elevated, while, if the volume resistivity is below the lower limit, the desired temperature cannot be reached unless a large current is supplied with an extremely low voltage, so that these cases are not practical for use in the electrothermal color-varying instrument of the present invention.

FIG. 22 shows the relationship between the stable temperature of the heat generating element and the ambient temperature. A heated member stabilizes at a temperature where the amount of heat generation by the heat generating element per unit time coincides with the amount of heat dissipation per unit time, and the heat generating element of the present invention shows stabler thermal characteristics, with less influence by the ambient temperature, in comparison with a metallic heat generating element.

FIG. 23 shows the relationship between the generated temperature of the heat generating element and the energizing time thereof.

In the foregoing experimental data, the heat generating element was composed of a sintered $BaTiO_3$ material (15.0 mm diameter×1 mm thickness, 2.5Ω at 25° C.), while the metallic heat generating element was composed of a nickel-chromium wiring formed on a polyester film of a thickness of 0.1 mm, each fixed on a brass plate of an area of 30×30 mm and a thickness of 0.3 mm and supplied with a voltage of 1 V.

Electrodes for said electrothermal heat-generating element may be formed directly on said element by molten aluminum injection or nickel or tin plating on mutually opposed faces of said element, or on a conductive member or a heat-radiating fin maintained in direct contact with said element.

The electrothermal color-varying instrument of the present invention, employing the above-mentioned electrothermal heat-generating element as the heat source, can be classified into a first type in which the electrothermal heat-generating element mounted in a main body is maintained in contact with a heat-transmitting member constituting a heating end; a second type in which the heat generated by the heat-generating element is emitted as warm air by means of a blower mechanism; and a third type formed as a box with a heating space therein, for detachably accommodating a color-varying member.

In the first type, the heat-transmitting end 4 may be realized in various forms, for example of a writing or coating utensil, a form with a flat end face and with various cross sections, a stamp form, a comb form for varying the color of hairs of a color-varying doll toy, a concave form for covering said hairs entirely to change the color thereof, a pressing iron form for varying the color of a dress of said doll toy, a lipstick form for make-up for said doll toy, or a recessed or container form for filling with water for varying the color of a thermal color-varying fish or a color-varying food toy in a cooking toy.

The above-mentioned heat transmitting member 4 is effectively made of a metal in consideration of heat transmission and heat retention, but a thin ceramic, plastic or other material may also be used as long as sufficient heat transmission is ensured.

In case the heat transmission member 4 is composed of a metal, it may be covered with a covering member 5 composed for example of heat-transmitting silicone rubber or thin plastic film for obtaining smooth touch to a contact surface thereby improving the writing performance or providing suitable elasticity thereby obtaining a sharp image.

Figure 2:
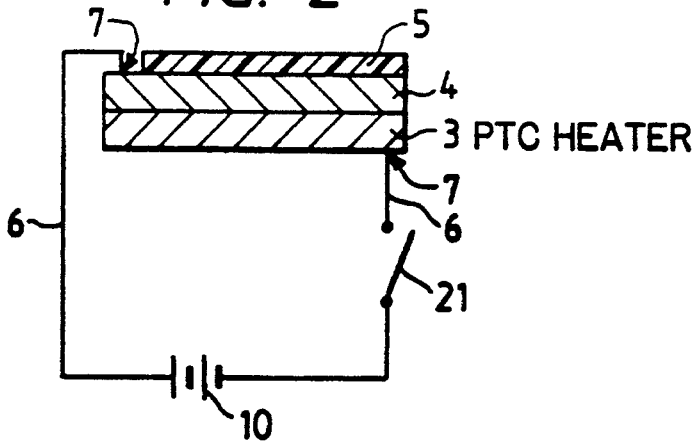
Figure 3:
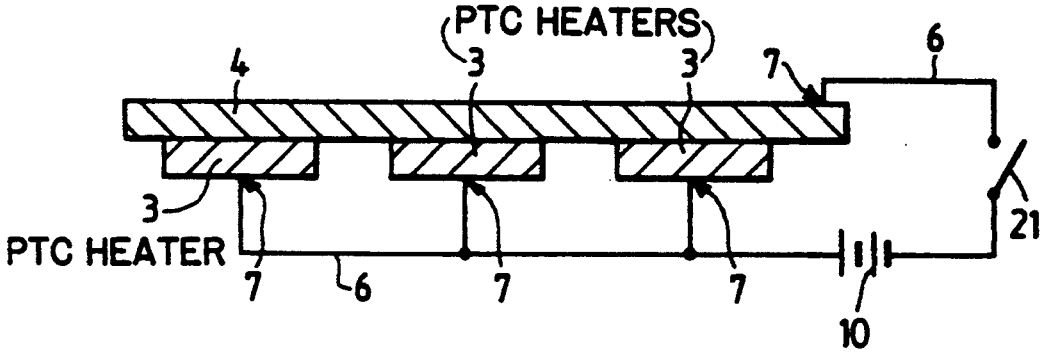

Electrodes 7 for the heat-generating element 3 may be provided on mutually opposed faces thereof. Otherwise an electrode is provided at the back of heat-generating element 3 while the other is provided on the front side of the conductive heat-transmitting member 4 (FIGS. 2 and 3).

Said electrodes 7 are connected, through conductive members such as lead wires 6, to a power source 10, which can be composed of various batteries or a commercial power supply, with a predetermined voltage in a range of 0.8–40 V.

The color-varying instrument 1 of the aforementioned second type is provided, in a main body casing 2, at least with a heat-generating mechanism and a blower mechanism, thereby continuously emitting warm air from an outlet 18 provided at an end of said casing 2. The blower mechanism is provided with a fan 16 mounted on the driving shaft of a small motor 15 of an output of 0.1–2 W and a revolution of 1500–2000 rpm and the heat-generating mechanism has the electrothermal heat-generating element 3 in a position capable of warming the air supplied by said fan 16.

The heat-generating mechanism can achieve effective heat radiating effect by employing heat radiating fins 12 in combination with the heat-generating element 3. However, even without such heat radiating fins, said mechanism may also be composed of a plurality of plate-shaped heat-generating elements in suitable combination or a honeycomb-shaped heat-generating element 3, in a position capable of warming the air.

The blower mechanism may be practically composed of the fan 16 mounted on the shaft of a conventional general-purpose small motor 15.

The motor 15 and the heat generating element 3 are connected to and energized by the power source.

The power source 10 may be composed of various batteries or a commercial power supply, of which voltage is regulated to a predetermined value (0.8–40 V). The battery can be detachably housed in the main body casing 2 or in a holding portion 20. Otherwise the instrument may be energized from an outside power source.

An output member 17 is provided for effectively emitting the warm air generated in the main body casing 2, and the output 18 thereof may be effectively reduced in diameter, flattened in shape or branched.

The color-varying instrument 1 of the third type is provided, at least in a part of inner walls of a box, with a metal plate 21, behind which the electrothermal heat-generating is energizably mounted.

In such instrument 1 of said third type, the electrothermal heat-generating element 3 is preferably provided with electrodes for facilitating energization and mounting. Such electrodes may be formed by molten aluminum injection or nickel or tin plating on the mutually opposed faces of said heat-generating element 3, or on the metal plate 21 maintained in contact with said heat-generating element 3. Said electrodes are connected, through conductive members such as lead wires 6, to the power source 10, which can be composed of various batteries or a commercial power source of which voltage is regulated to a predetermined value (0.8–40 V).

If a battery is employed as the power source, it may be detachably housed in the main body to constitute an electrothermal heating box. However, it may also be energized by an outside power source.

The electrothermal color-varying instrument 1 of the present invention can be effectively utilized for a toy, a picture book, a teaching aid, a writing board, a fortune telling game or a game toy, bearing the thermal color-varying layer 8 in at least a part of the surface.

The above-mentioned thermal color-varying layer 8 is composed of a system containing a known thermal color-varying material capable of reversible color change such as liquid crystal, a three-component color-varying material consisting of an electron-donating color-forming organic compound, a color developer therefor and a compound for inducing the color-forming reaction of the foregoing two components, or resinous particles containing the above-mentioned components in solid solution (for example those disclosed in Japanese Patent Publications No. 51-35414, No. 51-44706, No. 52-7764 and No. 1-29398 and Japanese Laid-open Patent No. 60-264285) and having a color varying point within a range of 20° C.–65° C. (preferably 30° C.–50° C.).

Among the above-mentioned materials, a coloring material disclosed in Japanese Laid-open Patent No. 60-264285 has a hysteresis as shown in FIG. 24, wherein the curve indicating the change in color density as a function of temperature ascent is different from that in case of temperature descent, and both curves constitute a loop structure when combined. Thus the color change takes place at a heating temperature $t_2$ or higher, and the varied color is retained at the normal temperature, even after the application of heat is terminated. The electrothermal color-varying instrument 1 of the present invention can be combined with an object article equipped with the thermal color-varying layer 8 of a material containing the above-explained coloring material, and there can be obtained improved effectiveness by combination with a heating/cooling instrument. In such coloring material, the varied color can be reversed to the original before change by cooling to a temperature $t_1$ or lower.

Under voltage application, the heat-generating element 3 elevates temperature by heat generation, whereby the resistance increases rapidly and the temperature elevation rate gradually decreases. Thus said element stabilizes at a temperature where the amount of heat generation is equal to the amount of heat dissipation, whereby temperature self-control is realized (see FIG. 22).

In the relationship between the generated temperature and the energizing time, the metallic heat-generating element shows slow temperature elevation because of a substantially constant heat generation per unit time, based on an extremely small temperature-dependent change of resistance, whereas the electrothermal heat-generating element 3 of the present invention shows a large current to provide a large temperature elevation rate immediately after the start of energization, thereby rapidly reaching the desired temperature.

With regards to the change in ambient temperature, the electrothermal heat-generating element 3 stabilizes at ca. 33° C. or ca. 38° C., respectively at an ambient temperature of 20° C. or 28° C., thus showing a change of 5° C. in the stabilizing temperature. On the other hand, the metal heat-generating element, because of small temperature-dependent change in the amount of heat generation per unit time, stabilizes at ca. 32° C. or ca. 39° C., respectively at an ambient temperature of 20° C. or 28° C., thus showing a change of 7° C. in the stabilizing temperature. As indicated by these experimental data, the electrothermal heat-generating element 3 of the present invention shows a smaller temperature change, in response to a change in the ambient temperature, than in the metallic heat-generating element.

The electrothermal heat-generating element 3 satisfying the aforementioned conditions (i), (ii) and (iii) exhibits the above-explained behaviors by the application of a low voltage (0.8–40 V), and performs temperature self-controlling function in a low temperature range (not exceeding 70° C.), thereby realizing desired thermal characteristics.

In the color-varying instrument of the warm air-emitting type, the heat-generating element 3 likewise starts temperature elevation by heat generation under the voltage application, but, in the initial stage, a large current in said heat-generating element 3 induces a significant voltage drop of the battery based on the internal resistance thereof, whereby the revolution of the motor 15 is lowered and the amount of blown air becomes limited. However, with the temperature elevation of the heat-generating element 3, the current therein decreases to elevate the terminal voltage of the battery, whereby the revolution of the motor 15 is elevated to increase the amount of blown air and the temperature elevation of the blown air becomes faster. In a system employing a metal heat-generating element composed for example of nickel-chromium, the revolution of the motor 15 is constant from the start of voltage application without the influence of temperature of the heat-generating element 3, so that rapid temperature elevation of the blown air cannot be attained.

The electrothermal color-varying instrument 1 of the present invention is designed at a temperature capable of inducing color change in an object article of which the thermal color-varying layer 8 has a color varying point within a range of 20° C.–60° C., thereby providing a color different from that at the normal temperature.

EXAMPLE 1

Figure 4:
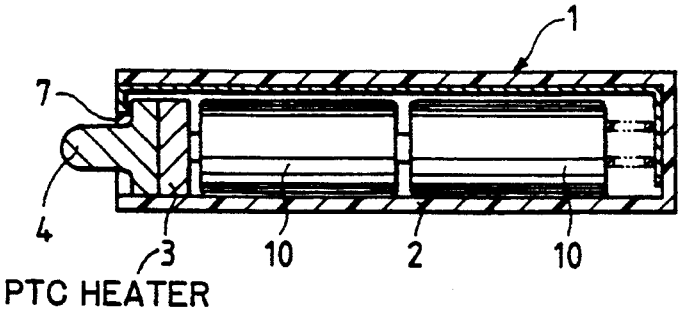
FIG. 4 is a longitudinal cross-sectional view of an example.
Figure 5:
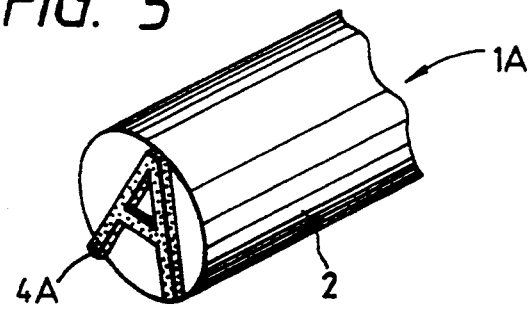
FIG. 5 is a partial perspective view of the end portion of another example.

An electrothermal color-varying instrument 1 shown in FIG. 4 is provided with a main body 2 of a plastic material; a heating member consisting of a heat transmitting member 4 with a writing end portion protruding from a flat base portion and an electrothermal heat-generating element composed of sintered $BaTiO_3$ (15 mm diameter×1 mm, 2Ω at 25° C., saturation temperature 45° C.), having conductive plated layers on both sides and adhered integrally with a conductive adhesive material to the rear face of said flat base portion; and two batteries of 1.5 V, serially arranged and connected through a conductive member with an electrode 7 in the front side of the flat base portion of the heat transmitting member 4. A power switch (not shown) is provided in a suitable position.

In said electrothermal color-varying instrument 1, in an ambient temperature of 25° C., the writing end portion was heated to about 45° C. after 30 seconds from the start of energization.

EXAMPLE 2

Figure 6:
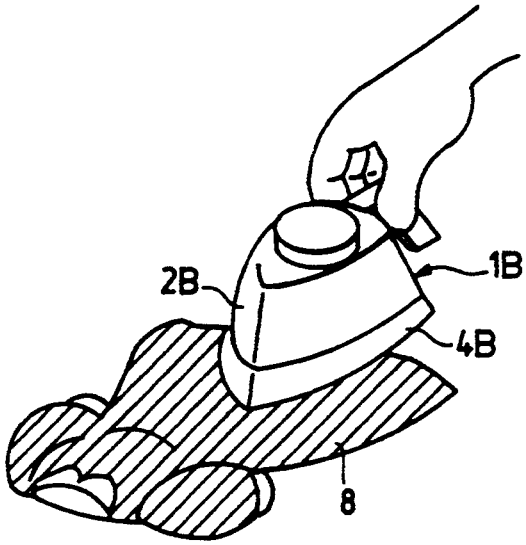
FIG. 6 is a schematic view showing a state of causing color change in a doll dress bearing a thermal color-varying layer thereon, by means of the electrothermal color-varying instrument of the present invention.

An electrothermal color-varying instrument 1 of the form of a pressing iron, shown in FIG. 6, is provided with a main body 2B of a plastic material; and a heating element consisting of a heat transmitting member 4B of an aluminum plate of 60×30×1 mm positioned at the bottom of said main body and three electrothermal heat-generating elements of a same size, adhered serially with a suitable spacing therebetween on the rear face of said heat transmitting member 4B by means of a conductive adhesive material, wherein each of said heat-generating elements is composed of sintered $BaTiO_3$ (15 mm diameter×1 mm, 2.5Ω at 25° C., saturation temperature 45° C.) having conductive plated layers on both sides, and the heat-generating elements are connected (in the same manner as shown in FIG. 3) by electrodes (unillustrated) at the rear face of the said elements 3 and an electrode (unillustrated) formed on the heat transmitting member 4B through lead wires so as to be energizable by a voltage of 3 V.

The exposed bottom of said heat transmitting member 4B may be provided with fluorinated or silicone resin coating for improving the slidability at use. Also a reversible thermal color-varying indicator may be suitably provided for confirming the generated temperature.

APPLICATION EXAMPLE 1

Figure 8:
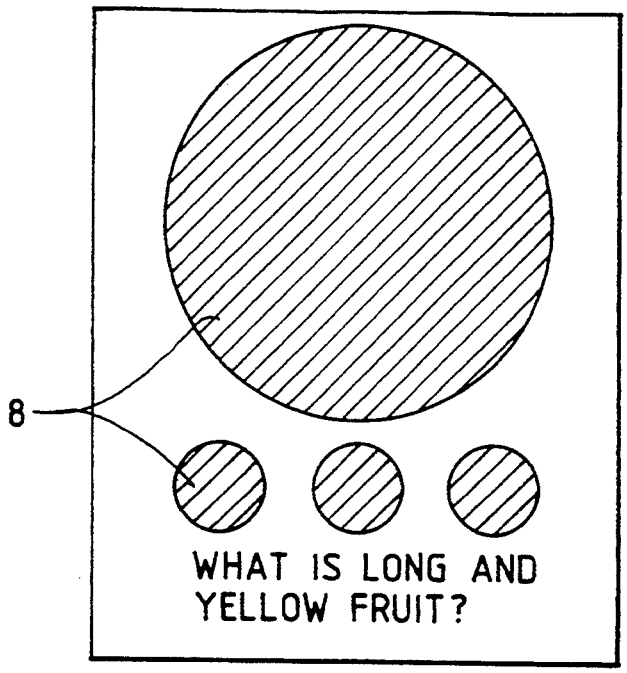
FIG. 8 is a view of a picture book in which a non-varying image is concealed by a thermal color-varying layer.
Figure 9:
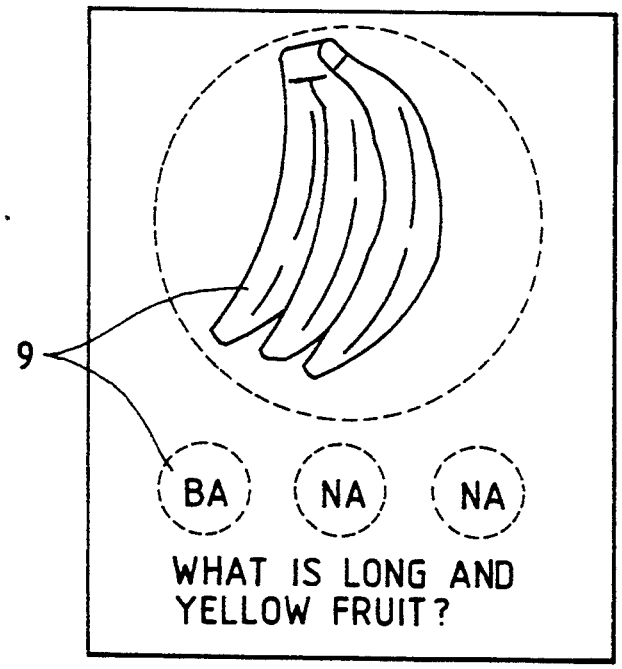
FIG. 9 is a view of said picture book in which the non-varying image is revealed by color change in the concealed portion.
Figure 10:
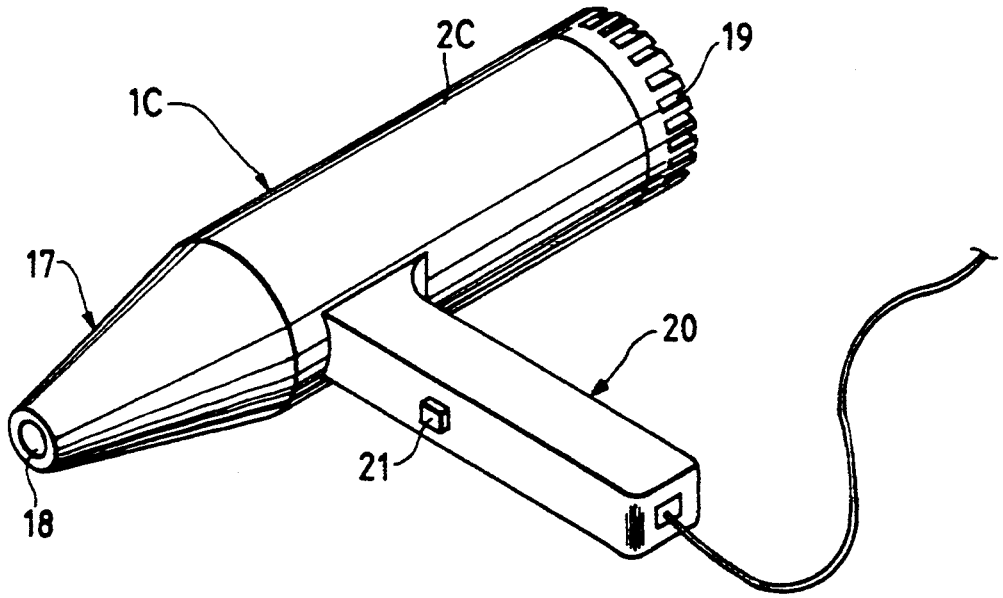
FIG. 10 is a perspective view of an example of a second embodiment of the electrothermal color-varying instrument of the present invention.
Figure 11:
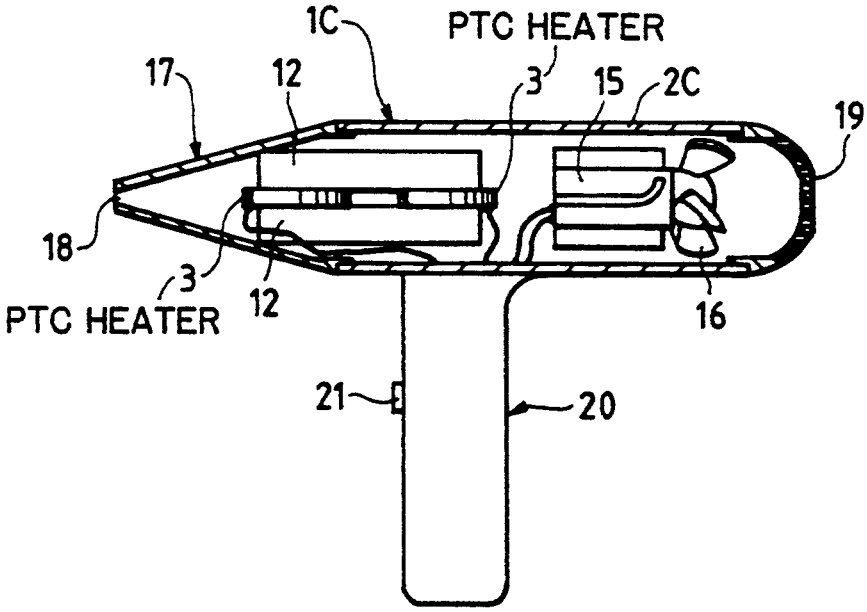
FIG. 11 is a schematic view of the interior of the color-varying instrument of FIG. 10.
Figure 12:
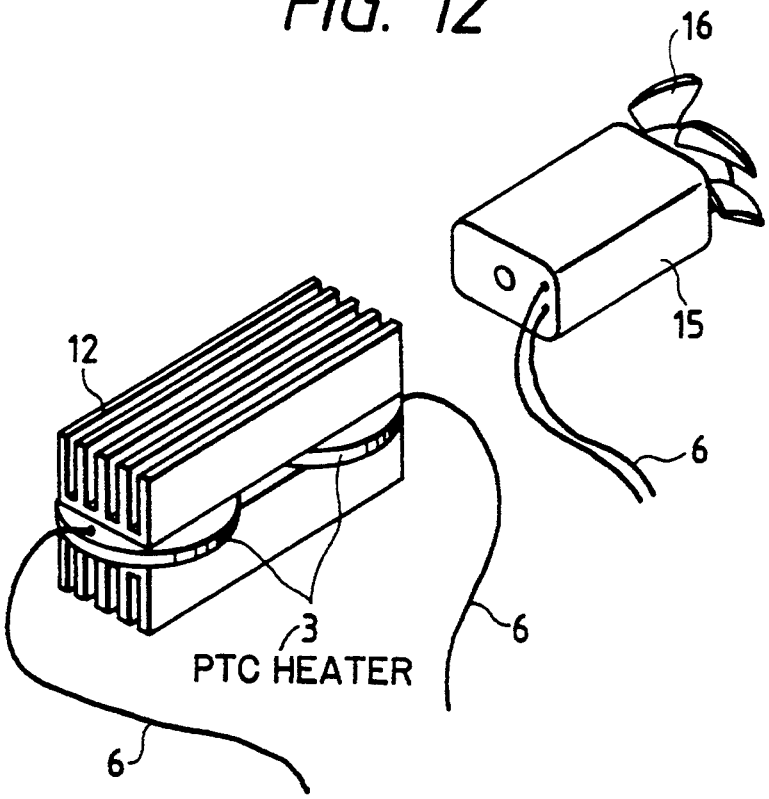
FIG. 12 is a partial schematic view of a heat-generating mechanism and a blower mechanism.

There was prepared a picture book for children, in which an answer part was concealed with a reversible color-varying layer 8. More specifically, a pattern and characters of banana were printed with ordinary yellow ink (non-varying layer 9), and were covered by a reversible thermal color-varying layer which was green at a temperature lower than 40° C. but changed to colorless at 40° C. or higher. When said thermal color-varying layer 8 was rubbed with the electrothermal color-varying instrument 1 of the example 1 in the heated state, said layer 8 became colorless, thereby revealing the answer printed in the non-varying layer 9 (see FIGS. 8 and 9). Said non-varying layer 9 returned to the concealed state at the normal temperature.

APPLICATION EXAMPLE 2

Figure 7:
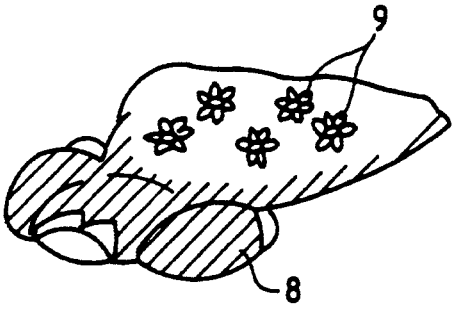
FIG. 7 is a schematic view showing another aspect of said dress developed by color change.

There was prepared a doll dress bearing a thermal color-varying layer 8 of a coloring material containing a temperature-sensitive material with color hysteresis. More specifically, a pale blue cloth printed with flower patterns in yellow and pale green colors (non-varying layer 9) was entirely covered with a thermal color-varying layer 8 which appears red or colorless with $t_1$ at 15° C. and $t_2$ at 32° C. whereby the dress appears as red at the normal temperature. When said dress was pressed with the preseing iron-shaped color-varying instrument 1 in the heated state, the contacted area became colorless immediately. By the pressing of the entire surface, there appeared flower patterns on pale blue background, which were retained at the normal temperature (cf. FIGS. 6 and 7).

EXAMPLE 3 (FIGS. 10-13)

An electrothermal color-varying instrument 1C is provided with a plastic main casing 2 (external diameter 3.5 cm×length 9.0 cm) divided longitudinally and rendered mutually engageable; a heat-generating mechanism and a blower mechanism energizably connected and housed in said casing; a holder portion 20 incorporating a switch mechanism (not shown) and mounted at the center of the main casing 2; an outlet member 17 mounted at a longitudinal end of the main casing 2C and gradually reduced to an outlet 18 of 6 mm diameter; and a member with air inlet holes 19, mounted at the other end.

The holder portion 20 may be so constructed as to accommodate batteries, or to be connected to an external power source through a cord.

The above-mentioned heat-generating mechanism was composed of two electrothermal heat-generating elements 3, each composed of sintered $BaTiO_3$ (15 mm diameter×1 mm, 2Ω at 25° C., saturation temperature 50° C.) having conductive plated layers on both sides, and upper and lower heat radiating fins 12, all assembled together with a conductive adhesive material.

The blower mechanism was composed of a small motor 15 (output 0.4 W, revolution 4000 rpm) housed in a box, and a fan 16 mounted on the shaft of said motor 15.

Figure 13:
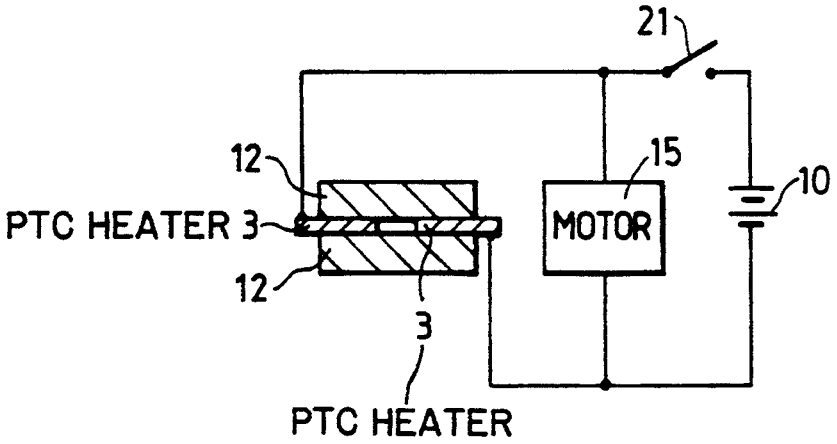
FIG. 13 is a circuit diagram of said heat-generating mechanism.

The heat-generating mechanism and blower mechanism were connected in parallel manner as shown in FIG. 13, and energized by a power source of 4.5 V, consisting of three batteries of 1.5 V in series, through a switch 21.

The above-explained electrothermal color-varying instrument 1 was capable of continuously emitting warm air of ca. 45° C. from the outlet 18, after 10 seconds from the start of energization.

EXAMPLE 4 (FIGS. 14 AND 15)

The heat-generating mechanism was formed by mounting, on a support member 14, an electrothermal heat-generating element 3 composed of sintered $BaTiO_3$ (25 mm diameter×1 mm, 2.5Ω at 25° C., saturation temperature 50° C.) having conductive plated layers on both sides and also having seven ventilation holes 11 of 2 mm diameter at suitable mutual spacing, in vertical position, pinching said element 3 with contact members 13 on both sides, and connecting said element 3 to the power source through lead wires 6.

The electrothermal color-varying instrument 1 was obtained by positioning said heat-generating mechanism coaxially with the blower mechanism.

APPLICATION EXAMPLE 3

There was prepared a bear doll covered with a napped fabric colored with a thermal color-varying material which was black at a temperature lower than 35° C. but changed to white at 35° C. or higher. When warm air was blown upon the bear doll by the electrothermal color-varying instrument 1 of Example 3, the blown area was changed to white. When the entire area was blown upon with warm air, the doll was changed to a white bear.

The doll returned to black at the normal temperature, and could be again changed to a white bear by repeated blowing of warm air.

APPLICATION EXAMPLE 4

Doll hairs were colored with a material containing a reversible heat-sensitive composition with color hysteresist, disclosed in Japanese Laid-open Patent Sho 60-264285, capable of changing from black to white at 35° C. or higher, remaining white at the room temperature and returning to black at 15° C. or lower. The hairs changed from black to white when blown with warm air from the electrothermal color-varying instrument of the Example 3, and remained white at the normal temperature. Color changes between black and white could be repeated by cooling at 15° C. or lower and blowing with warm air at 35° C. or higher.

EXAMPLE 5 (FIGS. 16 TO 19)

In a housing space 2D defined by a plastic casing, a metal plate 21 is positioned vertically and spaced from the internal walls. On the rear face of the metal plate 21, there were adhered, by a conductive adhesive material, two electrothermal heat-generating elements 3, each of which is composed of sintered $BaTiO_3$ (15 mm$\phi\times$1 mm, 2Ω at 25° C., saturation temperature 45° C.) having conductive plated layers on both sides, and which were connected, through lead wires 6, to a power source 10, consisting of two batteries of 1.5 V in series.

Opposed to the metal plate 21 and spaced by a distance of 3 mm, there was provided a heat insulation member 22 composed of foamed polystyrene, with a sponge at the back.

The above-explained heating box 1D was capable of elevating the temperature in the housing space 2 to about 45° C. after 10 seconds from the start of energization.

EXAMPLE 6 (NOT ILLUSTRATED)

In a plastic container of an area of 10×10 cm and a height of 15 cm, there were provided aluminum plates (thickness ca. 0.3 mm) 21 in mutually opposed relationship with a distance of about 1 cm from the lateral walls, and two electrothermal heat-generating elements 3A, each composed of sintered $BaTiO_3$ (15 mm diameter×1 mm, 2.5Ω at 25° C., saturation temperature 45° C.) having conductive plated layers on both sides, are fixed with a suitable spacing on the rear face of each aluminum plate and are energized through lead wires 6.

APPLICATION EXAMPLE 4

There was prepared a thermal color-varying card 25 on which an answer was written with yellow characters (non-varying image 9) and was concealed with a reversible thermal color-varying layer 8 which was green at a temperature lower than 40° C. but changed to colorless at 40° C. or higher. When card 25 was inserted into the heating box Example 6 and was then removed therefrom, the reversible thermal color-varying layer 8 was changed to colorless, thereby revealing the answer formed by said non-varying layer 9. At the normal temperature, said non-varying image 9 returned to the concealed state.

APPLICATION EXAMPLE 5

There was prepared a doll dress bearing a thermal color-varying layer 8 of a coloring material containing a temperature-sensitive material with color hysteresis. More specifically, a pale blue cloth printed with flower patterns in yellow and pale green colors (non-varying layer 9) was entirely covered with a thermal color-varying layer 8 which appears red or colorless with $t_1$ at 15° C. and $t_2$ at 32° C. whereby the dress appears as red at the normal temperature. When said dress was placed for about 10 seconds in the housing space of the heating box of the foregoing Example 6 and then removed, there were observed the flower patterns on the pale blue background, and this aspect was retained in the normal temperature.

APPLICATION EXAMPLE 6 (FIGS. 16 TO 19)

There was prepared a card 25 on which a pattern of Santa Claus (non-varying image 32) was concealed by a fir tree pattern 31 with a coloring material containing temperature-sensitive material with color hysteresis, showing green color or colorless state with $t_1$ at 15° C. and $t_2$ at 32° C. When card 25 was inserted into the housing space 2 of the heating box 1 of the example 5 and was then taken out therefrom, the green fir tree pattern 8 present before the insertion disappeared and the pattern of Santa Claus could be observed. This state was retained in the normal temperature range, but the original state in which the pattern of Santa Claus was concealed by the green fir pattern was restored by cooling to 15° C. or lower.

As explained in the foregoing, the electrothermal color-varying instrument of the present invention is capable of rapid heat generation in the electrothermal heat-generating layer to the predetermined temperature by the application of a low voltage, thereby inducing color change in the thermal color-varying layer, and is still free from the danger of overheating since the generated temperature is self-controlled to a desired saturation temperature in a low temperature range. Also since said instrument is based on an electrothermal system relying on a low voltage, there is no danger of current leakage. Consequently there is not required a coating on the heater for preventing said danger, and said instrument can be used safely even by children or infants.

Also since the power source can be composed of various batteries, there can be obtained a handy and portable electrothermal color-varying instrument in which the batteries are detachably mounted.

We claim:

1. An electrothermal color-varying instrument for inducing color change in a thermal color-varying layer, the instrument comprising an electrothermal heat-generating element serving as a heat source, and a heat transmitting member in face-to-face contact with said electrothermal heat-generating element, said heat transmitting member providing a heating end portion for transmitting heat to the thermal color-varying layer, said electrothermal heat-generating element comprising a thermistor comprising a sintered material of $BaTiO_3$ which has:

(i) a positive temperature coefficient on the electrical resistance within a temperature range from 25° to 70° C.;

(ii) a volume resistivity at 25° C. ($\rho_{25}$) within a range of $9.8\times10^{-3}$ to $2.97\times10^{5}$ Ω·cm; and (iii) a ratio ($\rho_{70}/\rho_{25}$) of the volume resistivity at 70° C. to that at 25° C. within a range of $5\leqq(\rho_{70}/\rho_{25})\leqq400$, wherein said electrothermal instrument generates heat under the application of a voltage in a range of 0.8 to 40 V and maintains a saturated heating temperature within a range of 30° to 100° C.

2. An instrument according to claim 1, wherein said heat transmitting member is formed as a writing utensil or a coating utensil.

3. An instrument according to claim 1, wherein said heat transmitting member is composed of a metal of which surface is covered by heat-transmitting silicone rubber or a plastic thin film.

4. An instrument according to claim 1, further comprising a main body having a space therein for receiving said thermal color-varying layer, wherein at least a portion of said space is defined by said heating end portion of said heat transmitting member, wherein said heating end portion of said heat transmitting member comprises metal.

* * * * *

UNITED STATES PATENT AND TRADEMARK OFFICE

CERTIFICATE OF CORRECTION

PATENT NO. : 5,376,772

DATED : December 27, 1994

INVENTOR(S) : TANEHIRO NAKAGAWA, ET AL.

It is certified that error appears in the above-identified patent and that said Letters Patent is hereby corrected as shown below:

ON TITLE PAGE

In [56] References Cited, under U.S. PATENT DOCUMENTS:
"3,354,564 11/1967 Emmons et al." should read
--3,354,565 11/1967 Emmons et al.-- and
"Kamgaito et al." should read --Kamigaito et al.--.

In [57] ABSTRACT, Line 4:
"face-to face" should read --face-to-face--.

COLUMN 2

Figure 14:
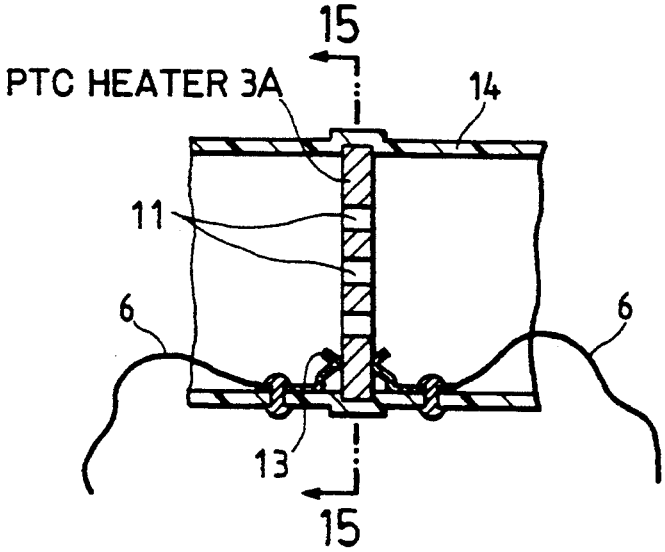
FIG. 14 is a longitudinal cross-sectional view of another example of the heat-generating mechanism.
Figure 15:
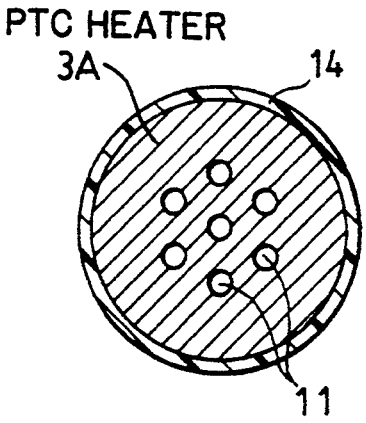
FIG. 15 is a cross-sectional view of said heat-generating mechanism along a line 15—15 in FIG. 14.
Figure 16:
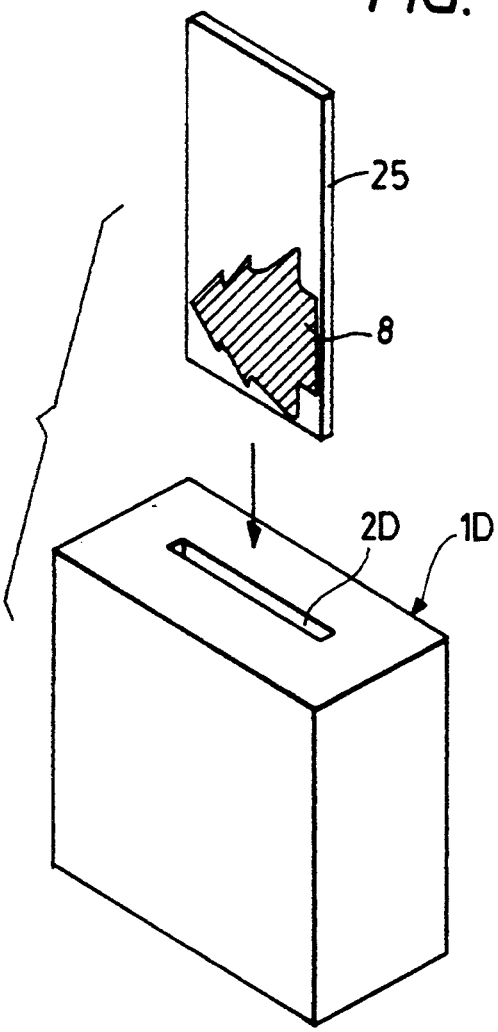
FIGS. 16 to 18 are schematic perspective views showing different states of use of an example of a third embodiment of the electrothermal color-varying instrument of the present invention, respectively showing a thermal color-varying card before, during and after insertion.
Figure 17:
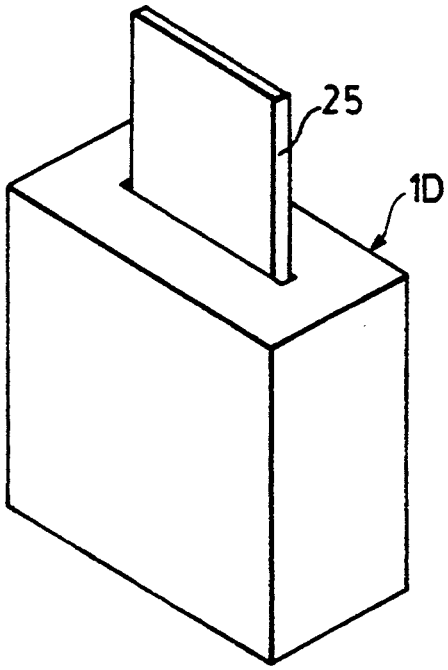

Line 8, "FIG. 14" should read --FIG. 14;--.
Line 24, "ture;" should read --tures;--.
Line 36, "8" should read --8 (see Fig. 6)--.

COLUMN 3

Line 7, "graphic" should read --graphite--.

COLUMN 4

Line 17, "4"should read --4 (see Fig. 4)--.
Line 42, "thereof." should read --thereof (FIG. 1).--.
Line 62, "said" should be deleted.

COLUMN 5

Line 6, "heat generating" should read --heat-generating--.
Line 22, "generating" should read --generating element 3--.

UNITED STATES PATENT AND TRADEMARK OFFICE

CERTIFICATE OF CORRECTION

PATENT NO. : 5,376,772

DATED : December 27, 1994

INVENTOR(S) : TANEHIRO NAKAGAWA, ET AL.

It is certified that error appears in the above-identified patent and that said Letters Patent is hereby corrected as shown below:

COLUMN 7

Line 16, "element" should read --element 3--.
Line 32, "instrument 1" should read --instrument 1B--.
Line 47, "said" should read --heat-generating--.

COLUMN 8

Line 3, "Said" should read --The--.
Line 16, "preseing" should read --pressing--.
Line 21, "(cf." should read --(see--.
Line 25, "casing 2" should read --casing 2C--.
Line 31, "casing 2;" should read --casing 2C;--.
Line 68, "said element 3" should read --the heat-generating element 3A--.

COLUMN 9

Line 1, "said element 3" should read --the heat-generating element 3A--.
Line 25, "teresist," should read --teresis,--.
Line 31, "the" (first occurrence) should be deleted.
Line 38, "plate 21" should read --plate 24--.
Line 39, "plate 21," should read --plate 24,--.
Line 42, "(15 mmφ" should read --(15 mm diameter--.
Line 48, "plate 21" should read --plate 24--.
Line 53, "space 2" should read --space 2D--.

COLUMN 10

Line 1, "EXAMPLE 4" should read --EXAMPLE 5--.
Line 9, "box" should read --box of--.

UNITED STATES PATENT AND TRADEMARK OFFICE

CERTIFICATE OF CORRECTION

PATENT NO. : 5,376,772

DATED : December 27, 1994

INVENTOR(S) : TANEHIRO NAKAGAWA, ET AL.

It is certified that error appears in the above-identified patent and that said Letters Patent is hereby corrected as shown below:

COLUMN 10

Figure 18:
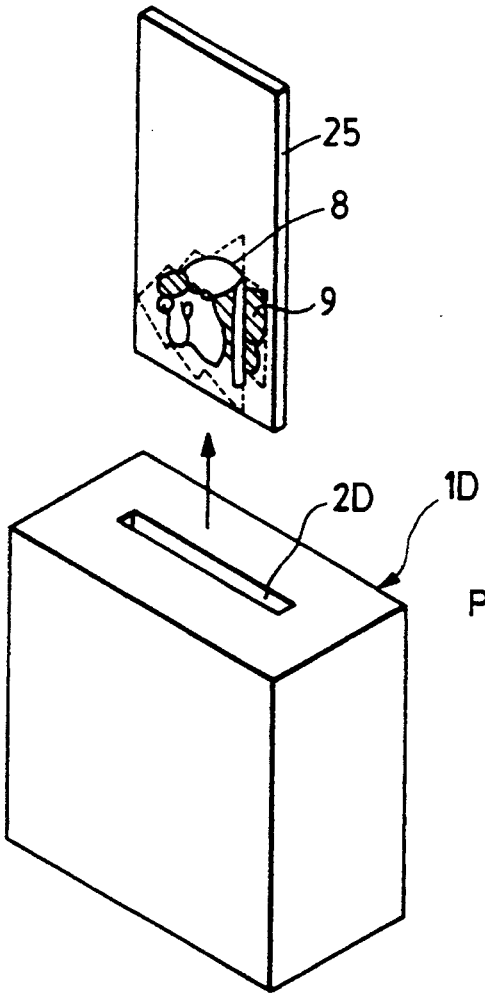
Figure 19:
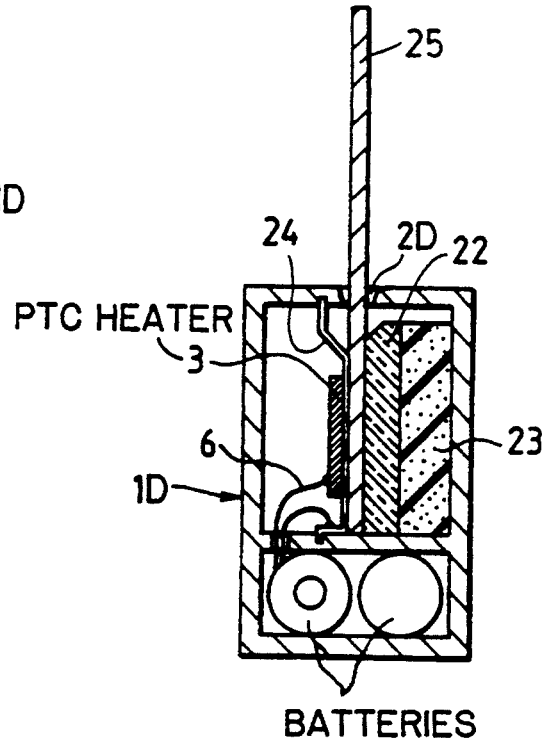
FIG. 19 is a cross-sectional view in the state shown in FIG. 17.
Figure 20:
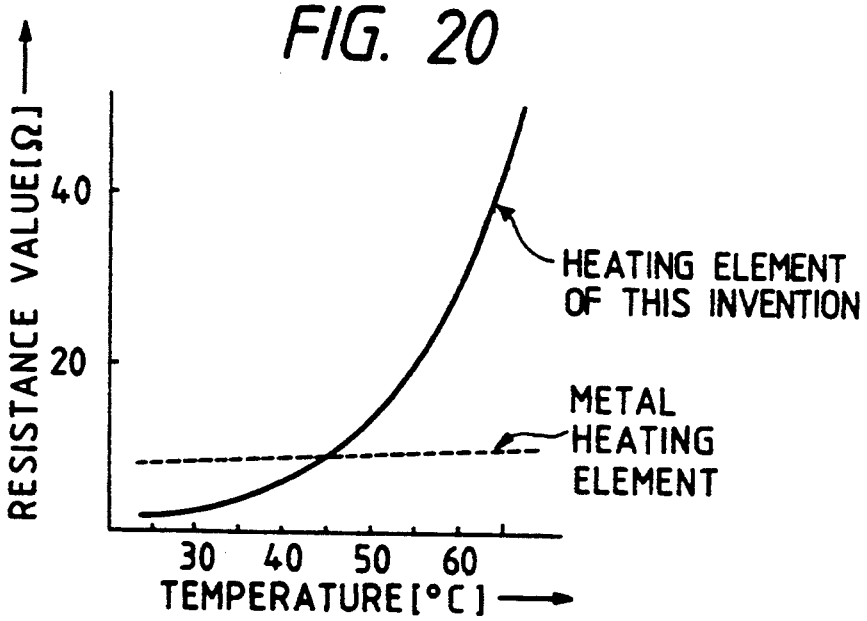
FIG. 20 is a chart showing resistance-temperature characteristics of the electrothermal heat-generating element of the present invention.

Line 15, "EXAMPLE 5" should read --EXAMPLE 6--.
Line 31, "EXAMPLE 6" should read --EXAMPLE 7--.
Line 33, "25" should read --25 (Fig. 18)--.
Line 34, "32" should read --9--.
Line 35, "31" should read --8--.
Line 39, "the example 5" should read --Example 5--.
Line 45, "fir pattern" should read --fir tree pattern 8--.

Signed and Sealed this

Twenty-fifth Day of July, 1995

Bruce Lehman

*Attest:*

BRUCE LEHMAN

*Attesting Officer*

*Commissioner of Patents and Trademarks*